US005890962A

United States Patent [19]

Takemoto

[11] Patent Number: 5,890,962

[45] Date of Patent: Apr. 6, 1999

[54] GAMING MACHINE WITH MULTIPLE INDEPENDENT DISPLAY GAMING AREAS

[75] Inventor: Takatoshi Takemoto, Tokyo, Japan

[73] Assignee: Kabushiki Kaisha Ace Denken, Tokyo, Japan

[21] Appl. No.: 666,451

[22] PCT Filed: Dec. 28, 1994

[86] PCT No.: PCT/JP94/02283

§ 371 Date: Jun. 28, 1996

§ 102(e) Date: Jun. 28, 1996

[87] PCT Pub. No.: WO95/17932

PCT Pub. Date: Jul. 6, 1995

[30] Foreign Application Priority Data

Dec. 28, 1993 [JP] Japan ..... 5-335818

[51] Int. Cl.[6] ..... A63F 9/22

[52] U.S. Cl. ..... 463/20; 273/143 R; 463/16; 463/31

[58] Field of Search ..... 463/20, 12, 13, 463/16; 273/143 R, 138 A, 85 CP; 364/412, 410

[56] References Cited

U.S. PATENT DOCUMENTS

| | | | |
|---|---|---|---|
| 4,240,635 | 12/1980 | Brown | 463/20 |
| 4,712,799 | 12/1987 | Fraley | 463/20 |
| 4,838,552 | 6/1989 | Hagiwara | 463/20 |
| 5,010,995 | 4/1991 | Okada | 273/143 R X |
| 5,375,830 | 12/1994 | Takemoto et al. | 273/143 R |

FOREIGN PATENT DOCUMENTS

| | | |
|---|---|---|
| 1 253 500 | 11/1967 | Germany . |
| 43 21 833 | 1/1995 | Germany . |
| 54-130590 | 9/1979 | Japan . |
| 55-118773 | 9/1980 | Japan . |
| 5-31431 | 2/1987 | Japan . |
| 2-305584 | 12/1990 | Japan . |
| 4-220276 | 8/1992 | Japan . |
| 2 107 103 | 4/1983 | United Kingdom . |
| 2 213 624 | 8/1989 | United Kingdom . |

*Primary Examiner*—Michael O'Neill
*Attorney, Agent, or Firm*—Seed and Berry LLP

[57] ABSTRACT

A plurality of display areas 110A–110I change and display a plurality of predetermined types of symbols in sequence, and a control section performs display control for causing each of the display areas to make a transition from display in a symbol stop condition to that in a dynamic condition in which the symbols change dynamically and further to make a transition from the display in the dynamic condition to that in the stop condition. An active gaming area determination section determines at least one display area used as an active gaming area among the plurality of display areas. A determination section determines whether or not a combination of the symbols displayed in each of the display areas selected by the active gaming area determination section is a predetermined combination when the display in the dynamic condition produced in the display areas determined by the active gaming area determination section becomes the display in the stop condition. A win processing section executes a predetermined game win process when the determination section determines that the combination of the symbols is the predetermined combination.

18 Claims, 13 Drawing Sheets

GAMING MACHINE WITH MULTIPLE INDEPENDENT DISPLAY GAMING AREAS

TECHNICAL FIELD

This invention relates to a gaming machine for combining symbols, such as a slot machine for changing display of a plurality of symbols and stopping the change of each symbol at a predetermined stop timing.

TECHNICAL BACKGROUND

With a conventional gaming machine for combining symbols, as described in Japanese Utility Model Laid-Open No. Sho 54-130590, a player inputs game play media such as pachinko (Japanese pinball) balls, medals, or coins to a slot, then rotates three drums on which symbols are displayed and presses stop switch buttons in order to stop the drum rotation. A predetermined number of game play media are paid out to the player for winning game play from the gaming machine in response to the symbol combination after the drums stop.

Another symbol combination gaming machine is provided with a CRT in place of rotating drums for displaying nine symbols in total on three columns×three rows on the CRT.

The conventional symbol combination gaming machine displays only one gaming face on which nine symbols are displayed; it is not very enjoyable and lacks power and amusement.

Gaming houses want to reduce the installation space of each symbol combination gaming machine for installing as many symbol combination gaming machines as possible, so that a large number of players can be gathered to thus increase profits. However, with the symbol combination gaming machines in the related art, the drum size is limited by the dimensions and the number of symbols displayed on each drum, and thus there are limitations to reducing the depth dimension.

DISCLOSURE OF INVENTION

It is therefore an object of the invention to provide an enjoyable, powerful, and amusing gaming machine for combining symbols.

To these ends, according to the invention, there is provided a gaming machine comprising:

a display section that can display a plurality of display areas for changing and displaying a plurality of predetermined types of symbols in sequence;

a control section for performing display control for causing each of the plurality of display areas to make a transition from display in a symbol stop condition to that in a dynamic condition in which the symbols change dynamically, and further to make a transition from the display in the dynamic condition to that in the stop condition;

an active gaming area determination section for determining at least one display area used as an active gaming area among the plurality of display areas;

a determination section for determining whether or not a combination of the symbols displayed in each of the display areas determined by the active gaming area determination section is a predetermined combination when the display in the dynamic condition produced in the display areas determined by the active gaming area determination section becomes the display in the stop condition; and a win processing section for executing a predetermined win process when the determination section determines that the combination of the symbols is the predetermined combination.

According to the invention, there is provided a gaming machine which may comprise:

a display section that can display a plurality of display areas for changing and displaying a plurality of predetermined types of symbols in sequence;

a control section for performing display control for causing each of the display areas to make a transition from display in a symbol stop condition to that in a dynamic condition in which the symbols change dynamically and further to make a transition from the display in the dynamic condition to that in the stop condition;

an active gaming area determination section for determining at least one display area used as an active gaming area among the display areas;

a determination section, when there is more than one display area determined by the active gaming area determination section, for determining whether or not a combination of the symbols displayed in the display areas is a predetermined combination; and a win processing section for executing a predetermined win process when the determination section determines that the combination of the symbols is the predetermined combination.

Further, according to the invention, there is provided a gaming machine which may comprise:

a display section that can display a plurality of display areas for changing and displaying a plurality of predetermined types of symbols in sequence;

a control section for performing display control for causing each of the display areas to make a transition from display in a symbol stop condition to that in a dynamic condition in which the symbols change dynamically and further to make a transition from the display in the dynamic condition to that in the stop condition;

an active gaming area determination section for defining a plurality of groups each being a combination of display areas used as active gaming areas among the display areas and determining one of the plurality of groups;

a determination section for determining whether or not a combination of the symbols displayed in each of the display areas determined by the active gaming area determination section is a predetermined combination when display in a dynamic condition produced in the display areas in the group determined by the active gaming area determination section becomes display in a stop condition; and a win processing section for executing a predetermined win process when the determination section determines that the combination of the symbols is the predetermined combination.

According to the invention, there is provided a gaming machine which may comprise:

a display section that can display a plurality of game areas in which a predetermined game is displayed;

a control section for controlling game display in each of the plurality of game areas on the display section; and an acceptance section for accepting an instruction concerning the game, wherein the control section is responsive to the instruction concerning the game accepted through the acceptance section for performing control in each of the game areas.

The operation in such means for solving problem is as follows:

A plurality of predetermined types of symbols are changed and displayed in sequence in the display areas. The control section performs display control for causing each of the display areas to make the transition from display in a symbol stop condition to that in a dynamic condition in which the symbols change dynamically and further to make the transition from the display in the dynamic condition to that in the stop condition.

The active gaming area determination section determines at least one display area used as an active gaming area among the plurality of display areas.

The determination section determines whether or not a combination of the symbols displayed in each of the display areas determined by the active gaming area determination section is a predetermined combination when the display in the dynamic condition produced in the display areas determined by the active gaming area determination section becomes the display in the stop condition. The win processing section executes a predetermined game win process when the determination section determines that the combination of the symbols is the predetermined combination.

Thus, at least one of the display areas is used as an active gaming display area, whereby an enjoyable, powerful, and amusing gaming machine is realized.

For example, if a selection acceptance section for accepting selection specification of at least one display area among the plurality of display areas is further included, the active gaming area determination section can determine the display area corresponding to the selection specification accepted through the selection acceptance section to be the display area used as the active gaming area.

If media acceptance means for accepting input of game play media used for playing a game, such as medals, and count means for counting the number of game play media accepted through the media acceptance means are further included, the active gaming area determination section can determine as many display areas as the number defined in response to the number of game play media counted by the count means to be the display areas used as the active gaming areas.

BEST MODE FOR CARRYING OUT THE INVENTION

A first embodiment of the invention will be discussed with reference to the accompanying drawings. The embodiment is provided with a display section which can display a plurality of display areas for changing and displaying a plurality of predetermined types of symbols in sequence, an active gaming area determination section for determining at least one display area used as an active gaming area among the plurality of display areas, and an active gaming area selection acceptance section for accepting selection specification of the active gaming area from a player; the display area selected by the player handling the selection acceptance section is made the active gaming display area.

Figure 1:
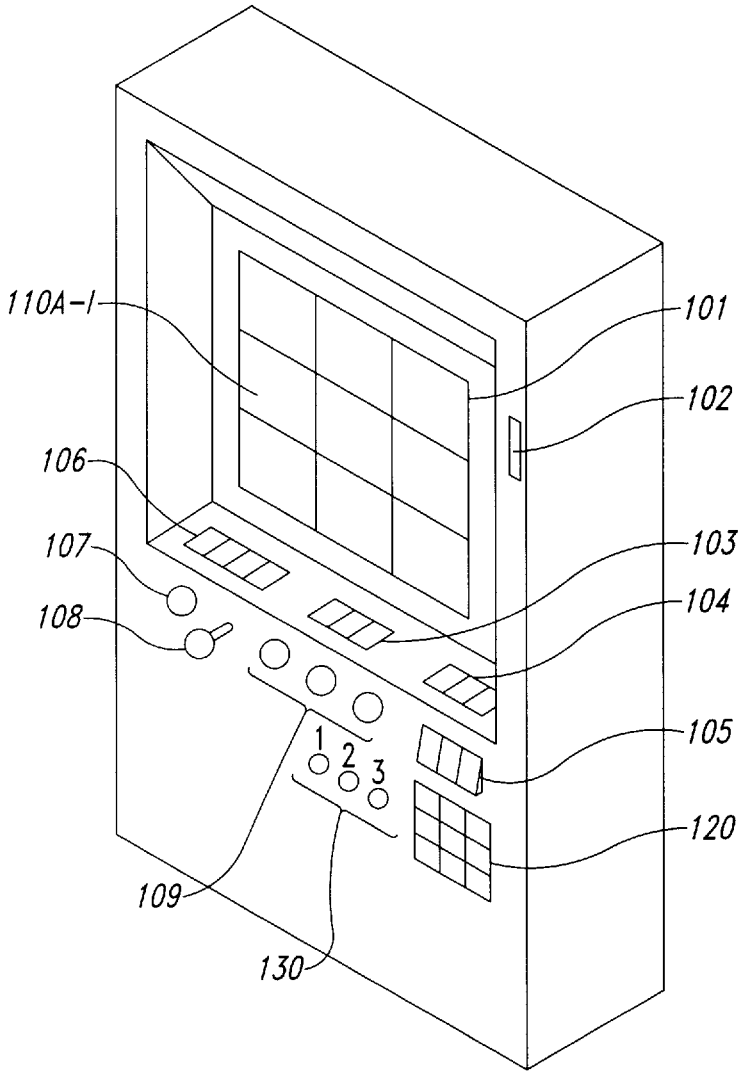
FIG. 1 is an external view of a slot machine showing the first embodiment of the invention.

FIG. 1 is an external view of a gaming machine in the first embodiment of the invention. The gaming machine in the embodiment includes, for example, a slot machine, pachinko machine, video game machine, etc. In the embodiment, the slot machine will be discussed.

In FIG. 1, a plurality of display parts 110A–110I can be placed on a game board 101. The display parts 110A–110I show a plurality of display areas. Each of the display parts 110A–110I is a display area that can be displayed by one display unit such as a CRT or liquid crystal display for displaying a plurality of slots each showing one or more columns of symbols on the slot machine and a background outside each slot. Each of the display parts 110A–110I corresponds to a display section of a conventional slot machine; the slot machine of the embodiment is provided with nine display parts as an example. Each of the display parts 110A–110I may be displayed on nine display units. They can change and display symbols as if the symbols rotated by moving the symbols and changing them in sequence. The display parts 110A–110I may display betting lines showing combinations of symbol positions at the gaming time and display a win when the symbol combination matches a predetermined one.

An input/output section 102 can comprise: an input/output section for inputting medals, balls, bills, and coins used with normal slot machines or the amount of money and the number of medals; and an input/output section for inputting/outputting gaming storage media for playing games, such as IC cards for storing the number of game play media, etc., FD(floppy disk), and CD-ROM. A number-of-won-media display section 103 is display means for displaying the number of game play media paid out to the player for a winning game play, which will be hereinafter referred to as the number of won media, or the number paid out to the player for a winning game play, such as the amount of money, when the symbols on the slot machine are complete as predetermined symbols. A number-of-taken-in-media-for-gaming display section 104 is display means for displaying the number of game play media or the amount of money input through the input/output section 102. A taken-in-media-for-gaming selection switch 105 is a specification switch for a player to specify the number of game play media or the amount of money for a bet when playing a game. If there are a plurality of betting lines indicating a plurality of symbol combinations, the player can use a betting line selection section 130 to select the betting line, as described later in a second embodiment of the invention. A number-of-internal-held-media display section 106 is display means for displaying the number of game play media or the amount of money, etc., held in the slot machine if the number of won media is not output. A settlement switch 107 is a specification switch for specifying settlement of the number of game play media held in the slot machine. For example, if the settlement switch 107 is pressed, as many game play media as held in the slot machine are output, or when a card comprising storage means is used, the number held in the slot machine can be stored on the card and this card can be dispensed. A start lever 108 is specification means for accepting a start instruction of rotation display of symbols on the slot machine. In the embodiment, the player can handle the start lever 108 to cause display of all display parts to make the transition to rotation display. Game stop switches 109, which are provided in a one-to-one correspondence with the columns, are specification means for accepting a game stop instruction. When a game stop instruction is accepted through one of the game stop switches 109, the corresponding symbol change is stopped at predetermined stop timing. It may be adapted to stop naturally after a lapse of a predetermined time after rotation display starts without providing the game stop switches 109. Further, only one game stop switch 109 may be provided without being provided in a one-to-one correspondence with the columns, and upon acceptance of a stop instruction through the game stop switch 109, the symbol changes may be stopped in a predetermined order.

A display selection acceptance section 120 is provided with selection specification buttons in a one-to-one correspondence with the plurality of display parts 110A–110I for accepting selection specification of at least one of the plurality of display parts 110A–110I. For example, if selection specification is allowed to be accepted during a specific time, the player is informed that the display parts can be selected, selection specification is accepted only during the specific time, and after a lapse of the specific time, the active gaming display part can be selected in response to the accepted display part selection specification. If the specific time is set to 20 seconds, for example, when the selection specification buttons corresponding to the display parts 110C, 110E, and 110G are pressed during 20 seconds, the display parts 110C, 110E, and 110G can be used as the gaming display parts. In this case, if no selection specification is given during the specific time, a predetermined display part, for example, only the display part E can be selected. After the start lever 108 is handled and each of the plurality of display parts makes the transition from display in symbol stop condition to that in dynamic condition, display part selection may be accepted.

The display selection acceptance section 120 may be provided with, for example, three buttons (1), (2), and (3) in place of the selection specification buttons in a one-to-one correspondence with the plurality of display parts 110A–110I; when (1) is pressed, only the display part E may be selected, when (2) is selected, the display parts D, E, and F may be selected, and when (3) is selected, all display parts 110A–110I may be selected. The selected display parts may be thus grouped and defined, whereby the player can easily select the display parts.

The display selection acceptance section 120 may be provided with a touch sensor on the front of each of the display parts in place of the selection specification buttons provided as shown in FIG. 1, enabling the player to touch the display parts 110A–110I for selection thereof.

Alternatively, a selection specification end button may further be provided instead of defining the specific time for selecting the display parts in response to the display part selection specification accepted before the selection specification end button is pressed. A start lever may also serve as the selection specification end button instead of providing the selection specification end button. In this case, when the start lever is handled after display part selection is accepted, rotation display is produced and the display parts selected so far are selected.

Alternatively, the display parts may be selected in response to the input number of game play media such as medals instead of accepting selection specification. For example, when one medal is input, only the display part E may be selected; when two medals are input, the display parts D, E, and F are selected; and when three medals are input, all display parts 110A–110I may be selected. In this case, a counter is provided for counting the number of input medals, and the display parts are selected in response to the number of medals counted by the counter. In this case, betting line selection responsive to the input number of game play media is suppressed and predetermined betting lines are used.

Each of the display parts 110A–110I can display indication such that it is selected when selected for gaming. For example, the selected display part can change background color. Alternatively, each display part may be provided with an indicator such as an LED for the selected display part to turn on its indicator. Alternatively, when the display selection acceptance section 120 is made up of the selection specification buttons in a one-to-one correspondence with the display parts 110A–110I, the selection specification buttons may be made illuminated buttons which are illuminated when pressed.

Next, the detailed internal configuration in the embodiment will be discussed with reference to FIG. 4, which is a block diagram of the slot machine in the embodiment.

Figure 4:
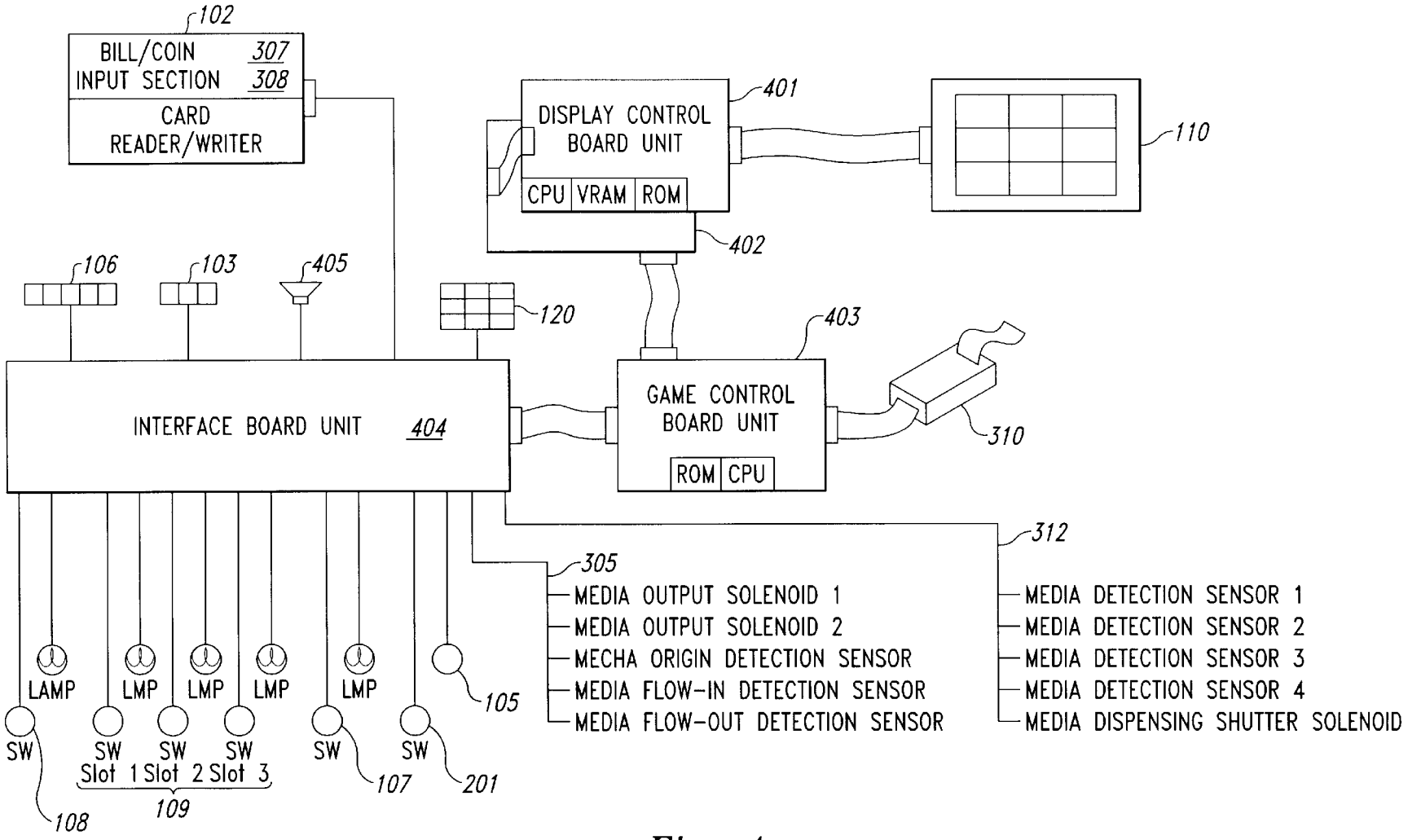
FIG. 4 is a block diagram showing the embodiment of the invention.

In FIG. 4, the slot machine comprises a game control unit 403 for controlling game progress, a display control unit 401 for simulating a slot rotation state, an interface board unit 404 connected to various input/output units, and a display section 110 for displaying the plurality of display parts 110A–110I described above. In FIG. 4, the game control unit 403 and the display control unit 401 are separate units each having a CPU. The game control unit 403 may comprise a card reader/writer 310 for reading/writing a card of a storage medium for storing the number of game play media, etc.

The interface board unit 404, to which the input/output section 102, the specification switches, the display means, etc., are connected, is controlled by the game control unit 403. The specification switches comprise at least the start lever 108 of start instruction means for accepting a game start instruction and instructing the display control unit 401 to change symbol display for each column, the stop instruction means 109 for accepting a stop instruction for stopping the symbol change for each column and instructing the display control unit 401 to stop the symbol change, and a display selection acceptance section 120 for accepting selection specification of at least one display part. The slot machine may further include a loudspeaker 405 for producing a sound when symbols are complete, etc.

In the entire system operation, the game control unit 403 controls game progress primarily in accordance with a program stored in a ROM and transmits slot rotation and stop instructions to the display control unit 401 via a parallel communication interface 402, thereby carrying out game progress. When slot rotation stops, the game control unit 403 determines that the combination of the symbols displayed at predetermined positions of the selected display part matches a predetermined symbol combination. When determining that the combination of the symbols matches the predetermined symbol combination, the game control unit 403 executes a predetermined game win process. To display symbols as if they rotated, the display control unit 401 stores various symbol patterns in a ROM and background pictures in a VRAM (Video Random Access Memory) and changes the symbol display mode of each slot. A plurality of the display operation modes of each slot can be provided, such as stop mode, acceleration mode, constant speed rotation mode, and deceleration mode. Symbol data in each mode is transmitted to the display section 110 in frame span units. The ROM may be formed detachably or may use an ultraviolet ray erasable and programmable read-only memory (EPROM) or an electrically erasable and programmable read-only memory (EEPROM). The display control unit 401 reads the symbol patterns stored in the ROM and the background pictures stored in the VRAM and performs display control for causing each of the plurality of display parts to make the transition from display in the symbol stop condition to that in the dynamic condition in which the symbols change dynamically, and further to make the transition from the display in the dynamic condition to that in the stop condition.

Figure 2:
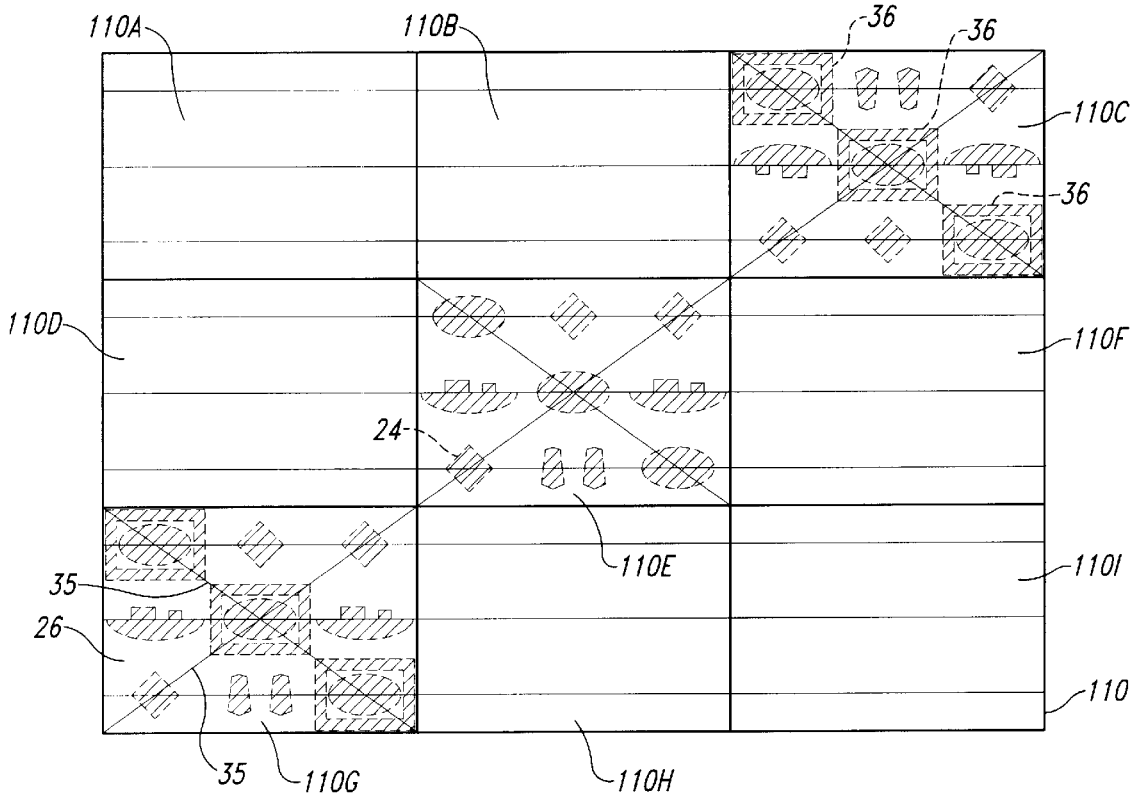
FIG. 2 is an illustration showing a display example of the slot machine showing the embodiment of the invention.
Figure 3A:
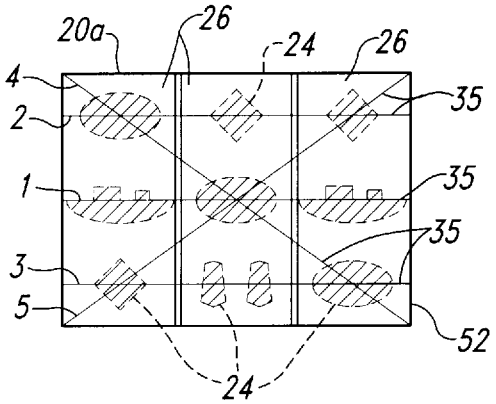
FIG. 3 is an illustration showing a display example of the slot machine showing the embodiment of the invention.

Next, a specific example of the display form in the display section will be discussed with reference to FIG. 2. As shown in the figure, the display section 110 is disposed on the front of the slot machine main body and is provided with nine display parts 110A–110I. As shown in FIG. 3 (A) and (B), nine symbols 24 (three rows×three columns) are displayed on each of the nine display parts 110A–110I and a player can play a game on each of the display parts. The number of displayed symbols is not limited to nine and a plurality of symbols may be displayed. Predetermined plurality of types of symbol patterns such as digits and star marks can be prestored as the symbols 24. Also displayed as part of the background, are line displays 35 indicating betting lines, frame displays 36 for displaying a win when the combination of the symbols displayed at specific positions is determined to be a predetermined combination, and background parts 26 showing other backgrounds, etc.

In the embodiment, five betting lines 1–5 are set on each selected display part, as shown in FIG. 3.

When a game start instruction is given, each of the display parts 110A–110I rotates and, when a game stop instruction is given, stops. In the stop condition, three symbols are displayed on the full display surface from top to bottom. If three game stop switches 109 are provided as shown in FIG. 1, for example, they can be placed in a one-to-one correspondence with three columns of each of the display parts 110A–110I. For example, a definition can be previously given so that when the leftmost one of the game stop switches 109 shown in FIG. 1 is pressed, the leftmost column of each of the display parts 110A–110I is displayed in the stop condition.

Next, the operation of the game control unit 403 will be discussed with reference to a game control flowchart in the game control unit 403 shown in FIG. 5.

First, necessary information stored at the gaming time in the game control unit 403 will be discussed with reference to FIG. 6.

Figure 6:
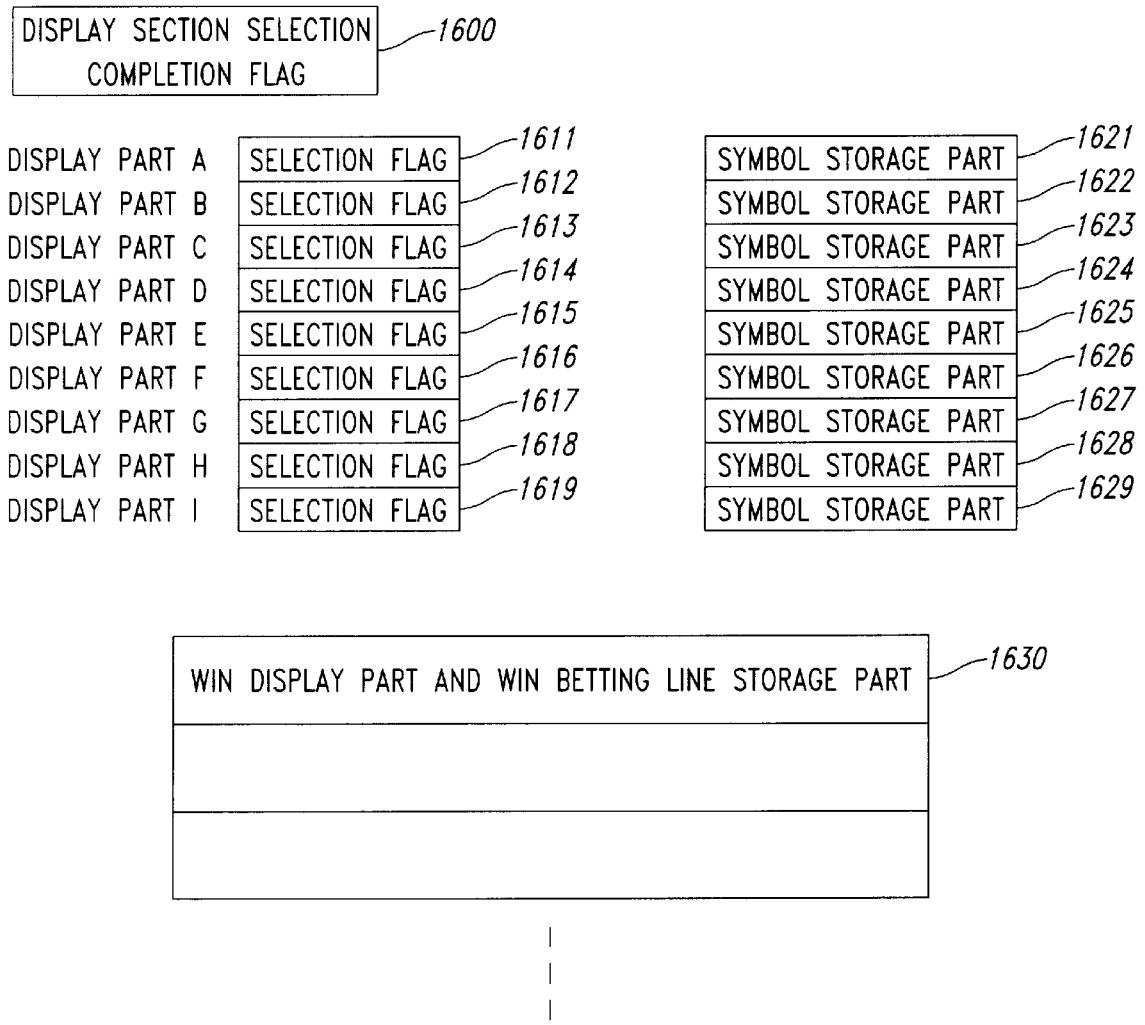
FIG. 6 is an illustration showing the storage contents of each storage part showing the embodiment of the invention.

In FIG. 6, a display selection completion flag 1600 is set upon completion of display selection and is reset when a game is started. As described above, a predetermined specific time as the selection acceptance time is measured, and display selection can be judged as complete after a lapse of the specific time since display selection acceptance. Selection flags 1611–1619 are provided in a one-to-one correspondence with the display parts. When one of the display parts is selected, its corresponding selection flag is set, and if a game win is determined, the flag is reset. Symbol storage parts 1621–1629 are provided in a one-to-one correspondence with the display parts. When symbol display changes from rotation display to stop condition display, identification codes of the displayed symbols are stored. In the embodiment, nine symbols are stored in the symbol storage part corresponding to each display part. The game control unit 403 can determine a game win by referencing the symbols stored in the symbol storage part.

A win display part and win betting line storage section 1630 stores the identification numbers of all of the win display parts and the win betting lines determined to be a win after game win determination. After win processing is performed, the storage section 1630 is cleared.

Figure 5A:
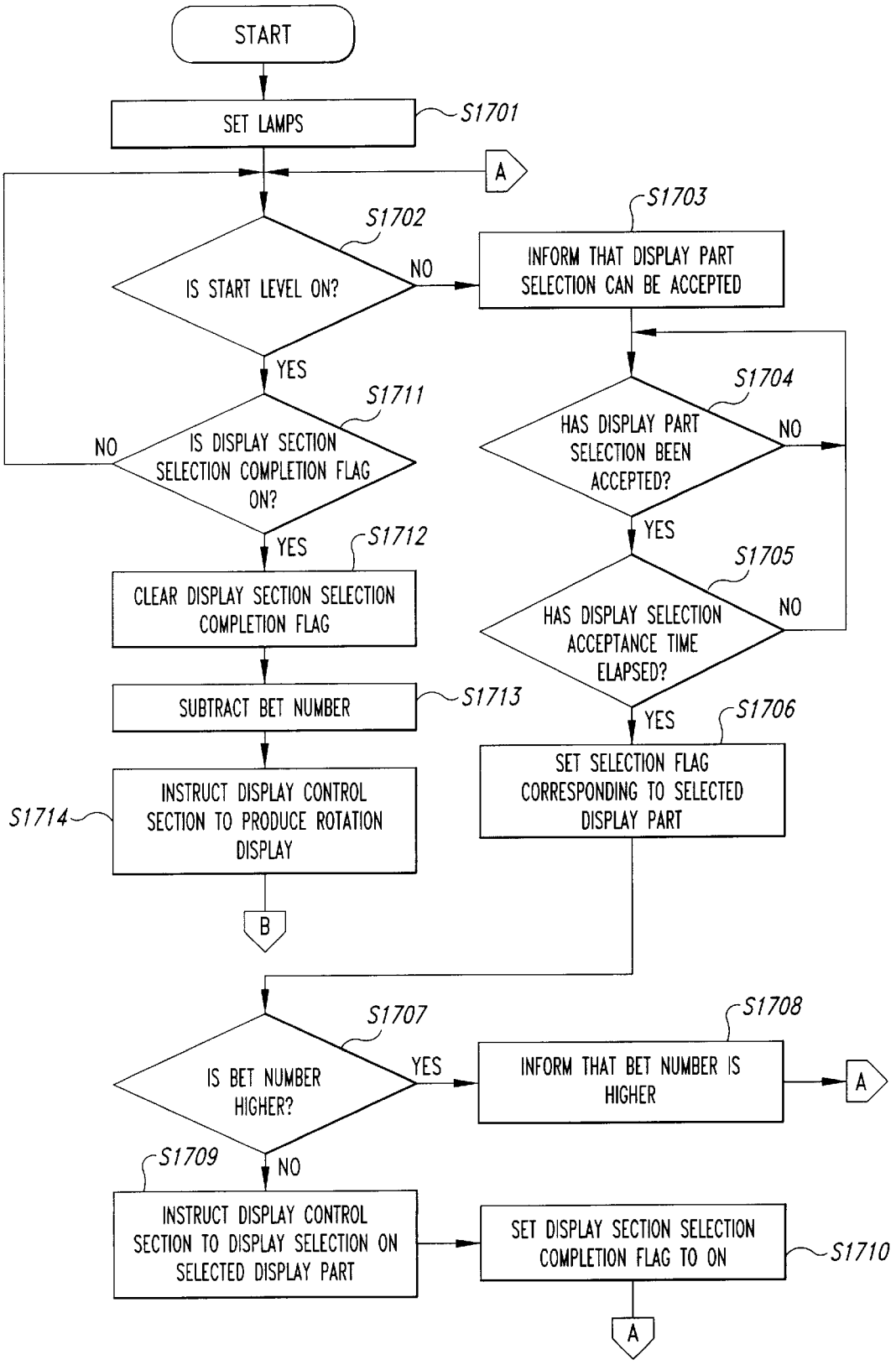
FIG. 5 is a flowchart showing the embodiment of the invention.
Figure 5B:
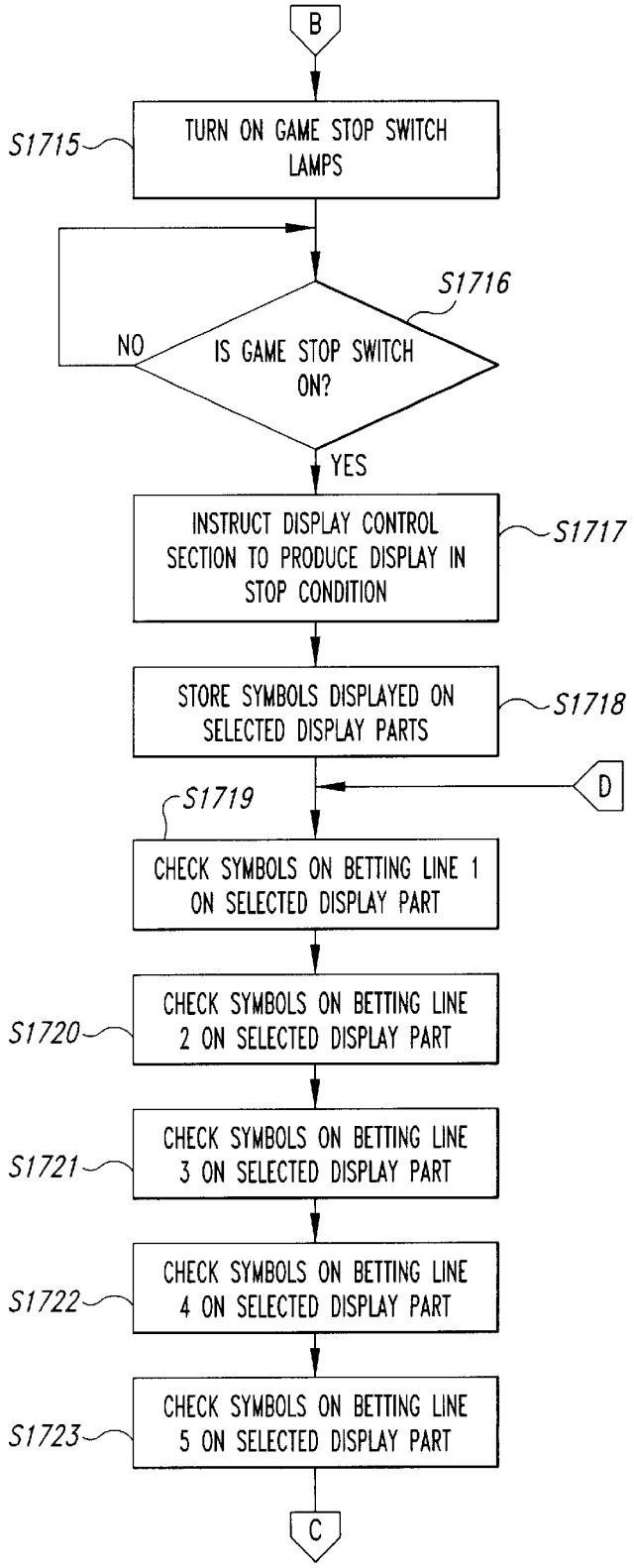
Figure 5C:
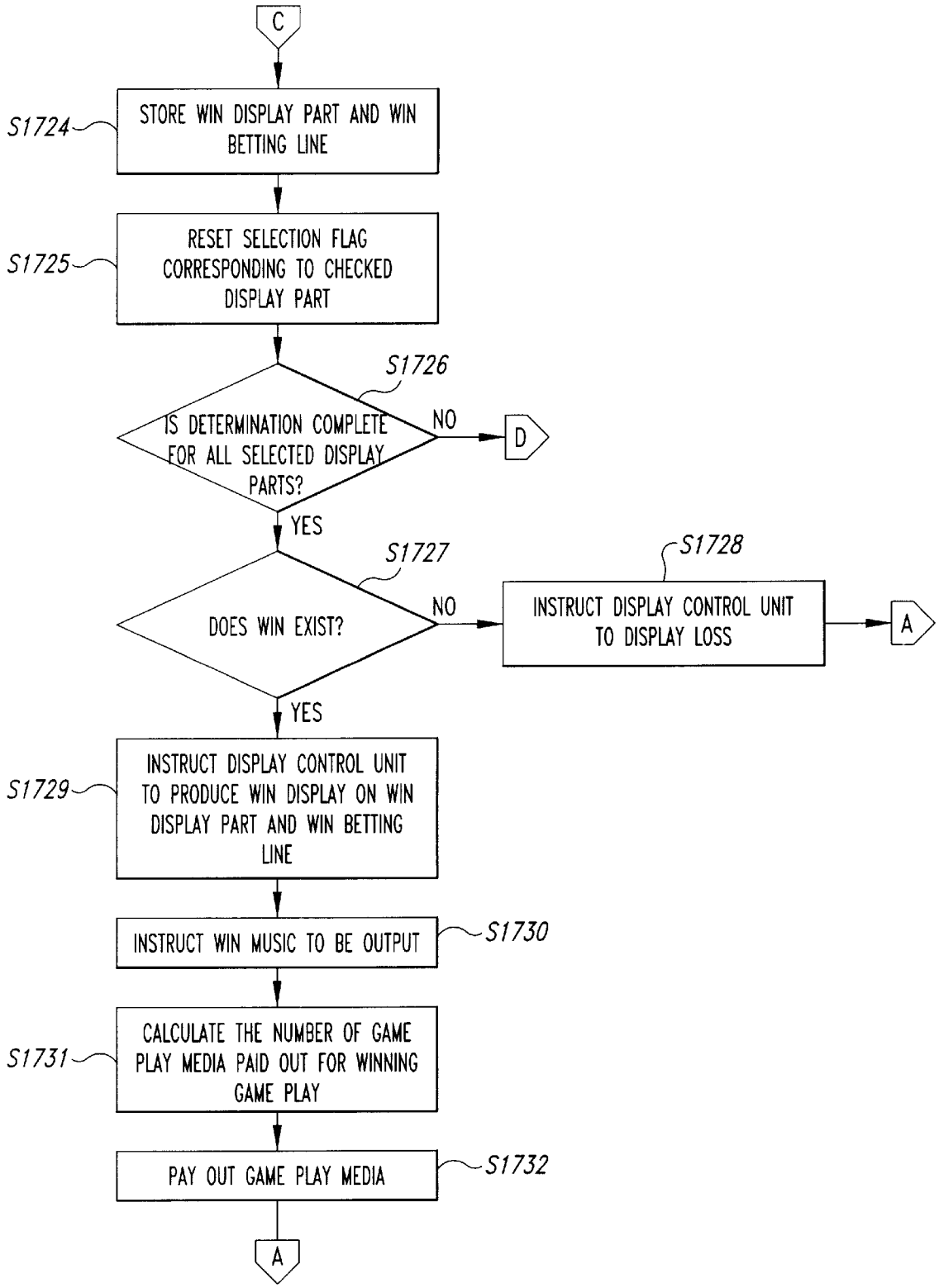

As shown in FIG. 5, when the power of the slot machine is turned on, the game control unit 403 causes the display parts to display symbols and turn on necessary lamps at step S1701. Next, it determines whether or not the start lever is set to ON at step S1702. If the start lever is not set to ON, the game control unit 403 informs a player that display part selection can be accepted at step S1703. When the player is informed, he or she operates the display selection acceptance section shown in FIG. 1 for specifying display part selection. Next, the game control unit 403 determines whether or not the display part selection has been accepted at step S1704 and determines whether or not a predetermined specific time, as the display selection acceptance time for accepting selection specification during the specific time since the player was informed, has elapsed, at step S1705. When no display parts are selected although the specific time has elapsed, the player may again be informed of display part selection acceptance. After a lapse of the specific time, the game control unit 403 sets the selection flag corresponding to the selected display part at step S1706. Next, it calculates the number of medals to be used for the bet required for the game corresponding to the number of selected display parts and determines whether or not the number to be used for the bet is higher than the number of medals specified with the taken-in-media-for-gaming selection switch 105 shown in FIG. 1 at step S1707. Alternatively, it may determine whether or not the number of medals to be used for the bet is higher than the number of medals actually input. For example, the required number of medals for the bet is previously defined corresponding to the number of selected display parts in such a manner that when one display part is selected, one medal is required for the bet, and that when three display parts are selected, three medals are required for the bet. If the number of medals to be used for the bet is higher than the actual number of medals, the game control unit 403 informs the player of the fact at step S1708. If the number to be used for the bet is not higher, the game control unit 403 instructs the display control unit 401 to produce predetermined display indicating selection on the selected display part at step S1709, and sets the display section selection completion flag at step S1710. To indicate that the display part is selected, for example, the display control unit 401 performs display control so as to change the background color. Next, the player sets the start lever to ON. When the game control unit 403 judges that the start lever is set to ON at step S1702, it determines whether or not the display section selection completion flag is ON at step S1711. Alternatively, after setting the display section selection completion flag, the game control unit 403 may request the player to set the start lever to ON. If the start lever is set to ON and the display section selection completion flag is not set, the game control unit 403 assumes that the start lever is OFF, and goes to step S1703 for requesting the player to select a display part.

Figure 3B:
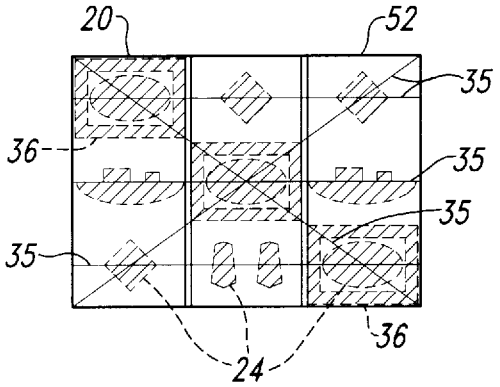

Next, the game control unit 403 clears the display section selection completion flag at step S1712, subtracts the above-mentioned number of medals to be used for the bet required for the game at step S1713, and instructs the display control unit 401 to produce rotation display at step S1714. When instructed, the display control unit 401 causes each of the plurality of display parts to make the transition from display in the symbol stop condition to that in the dynamic condition in which the symbols change dynamically. At this time, rotation display may be produced only on the selected display parts. Next, the game control unit 403 turns on the game stop switch lamps to indicate that a game stop instruction can be accepted at step S1715, and determines whether or not the game stop switch is set to ON at step S1716. If the switch is set to ON, the game control unit 403 instructs the display control unit 401 to cause the display parts to produce display in the stop condition at step S1717. When instructed, the display control unit 401 controls the display parts so that they make the transition from the display in the dynamic condition to that in the symbol stop condition. Next, the game control unit 403 stores the identification codes of the symbols displayed on each of the selected display parts in the symbol storage part corresponding to the display part at step S1718. Next, the game control unit 403 determines whether or not the symbol combination on betting line 1 displayed on one of the selected display parts matches a predetermined symbol combination at step S1719. Likewise, it determines whether or not the symbol combination on each of betting lines 2 to 5 matches a predetermined symbol combination at steps S1720 to S1723. If they match as a result of the determination, the game control unit 403 determines a win and stores the identification number of the win display part and that of the win betting line in the win display part and win betting line storage section 1630 at step S1724. Next, the game control unit 403 resets the selection flag corresponding to the checked display part at step S1725, and determines a win for other selected display parts at steps S1719–S1725. If the determination is complete for all the selected display parts at step S1726, the game control unit 403 references the win display part and win betting line storage section 1630 and determines whether or not a win exists at step S1727. If a win does not exist, the game control unit 403 instructs the display control unit 401 to produce display indicating no win, namely, a loss, at step S1728. A beep may be produced to inform the player of a loss. If a win exists, the game control unit 403 instructs the display control unit 401 to produce predetermined win display on the win display part and the win betting line as a win process at step S1729. When instructed, the display control unit 401 produces a display indicating the win, for example, as shown in FIGS. 2 and 3(B). Further, predetermined win music, such as a fanfare, may be output at step S1730. Next, the game control unit 403 calculates the number of game play media paid out for the winning game play at step S1731 and counts up the number of media displayed on the number-of-won-media display section 103 shown in FIG. 1 to as many as the calculated number of game play media, thereby paying out the media at step S1732. Game play media such as medals may be paid out instead of counting up the number of game play media. After the paying-out step, the game control unit 403 clears the identification numbers of the win display part and the win betting line stored in the win display part and win betting line storage section 1630 and returns to the first step, S1702. Then, the next game is started.

The game control unit 403 thus performs game control.

In the embodiment, the player is made to select display parts before setting the start lever to ON. However, selection specification may be accepted at the display selection acceptance section 120 after the display control unit 401 causes each of the display parts to make the transition from display in the symbol stop condition to that in the dynamic condition in which the symbols change dynamically.

Further, after selecting display parts, the player may be able to use a game multiplier factor selection switch 58 to set a magnification for the selected display parts. The defmed number of won media can be multiplied by the magnification.

Although the player specifies display part selection in the embodiment, the game control unit 403 shown in FIG. 4 in the gaming machine may determine the active gaming display parts at random.

The embodiment enables the player to play a game on display parts selected among the plurality of display parts for providing an enjoyable and powerful gaming machine. Further, the player is at liberty to select display parts and can have a sense of taking part in gaming and enjoy playing a game.

Next, a second embodiment of the invention will be discussed. In addition to the display part selection in the first embodiment, the second embodiment covers betting line selection with the betting line selection section 130 shown in FIG. 1 for accepting betting line selection specification. The external view, block diagram, etc., of the slot machine shown in FIGS. 1–4 may be similar to those in the first embodiment.

In the second embodiment, when there are plurality of betting lines showing symbol combinations, the betting lines can be set in response to player's selection. For example, three buttons (1), (2), and (3) are provided as the betting line selection section 130 as shown in FIG. 1. In addition, selection parts may be provided in a one-to-one correspondence with the betting lines.

Figure 7A:
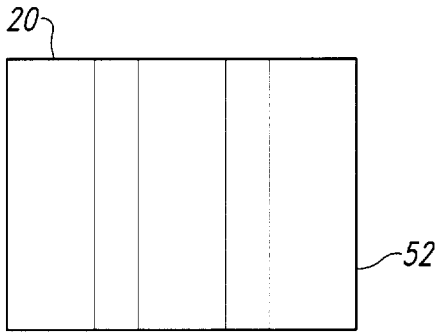
FIG. 7 is an illustration showing a display example of a slot machine showing the second embodiment of the invention.
Figure 7B:
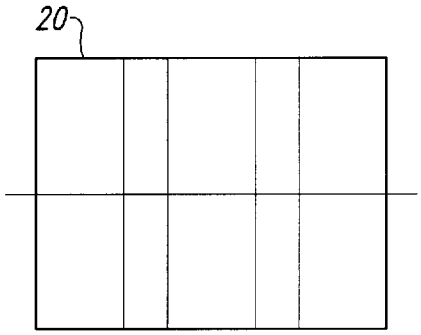
Figure 7C:
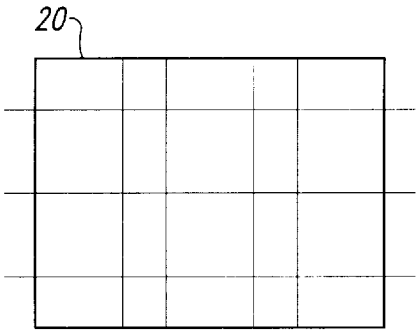
Figure 7D:
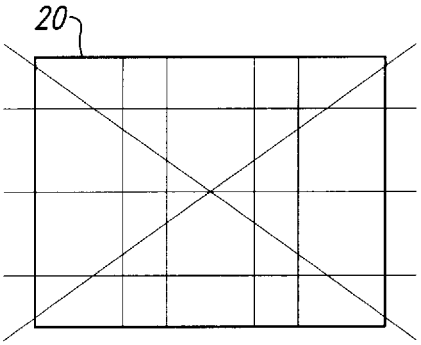

The betting lines are displayed on each of display parts; five betting lines 1–5 are available as shown in FIG. 3. The center line is betting line 1 and the top and bottom lines connecting symbols at top and bottom positions are betting lines 2 and 3 respectively. The diagonal line connecting each symbol at the top position of the left slot, the center position of the center slot, and the bottom position of the right slot is betting line 4. The diagonal line connecting symbols at the bottom position of the left slot, the center position of the center slot, and the top position of the right slot is betting line 5. In the embodiment, as shown in FIG. 7 (B), to use only the betting line 1 as the gaming target, which will be hereinafter referred to as selection (1), (1) in the betting line selection section 130 is pressed, to select the betting line; as shown in FIG. 7(C), to use the betting lines 1, 2, and 3 as the gaming target, which will be hereinafter referred to as selection (2), (2) in the betting line selection section 130 is pressed to select the betting lines; and, as shown in FIG. 7(D), to use the betting lines 1, 2, 3, 4, and 5 as the gaming target, which will be hereinafter referred to as selection (3), (3) in the betting line selection section 130 is pressed, to select the betting lines. The betting line selection section 130 and betting line selection can be previously defined in relation to a game control unit 403.

In the embodiment, common betting lines to the selected display parts are set. For example, as shown in FIG. 2, a player selects the display parts C, E, and G and presses (3) in the betting line selection section 130, whereby the betting lines 1, 2, 3, 4, and 5 are selected on all the selected display parts C, E, and G.

Alternatively, the player may select the betting lines for each of the selected display parts.

When the player selects betting lines through the betting line selection section 130, the selected betting lines are illuminated when displayed.

Further, after selecting betting lines, the player may be able to use a game multiplier factor selection switch 58 to set a magnification for the selected betting lines. The defined number of won media can be multiplied by the magnification.

Although the player specifies betting line selection in the embodiment, the game control unit 403 shown in FIG. 4 in the gaming machine may select the betting lines at random.

In the embodiment, after display parts are selected, for example, after S1710 in the flowchart shown in FIG. 5, the game control unit 403 informs the player that betting line selection can be accepted for accepting betting line selection through the betting line selection section 130. After accepting selected betting lines, the game control unit 403 instructs a display control unit 401 to display the selected betting lines. The display control unit 401 controls display of the selected betting lines.

This enables the player to furthermore select betting lines on the selected display parts, providing an amusing and enjoyable gaming machine.

Next, a third embodiment of the invention will be discussed. In addition to the display part selection in the first embodiment, the third embodiment further determines whether or not the combination of the symbols displayed at any predetermined positions on the selected display parts is a predetermined combination when more than one display part is selected. That is, an example will be given wherein a betting line is set across two or more display parts.

Figure 8:
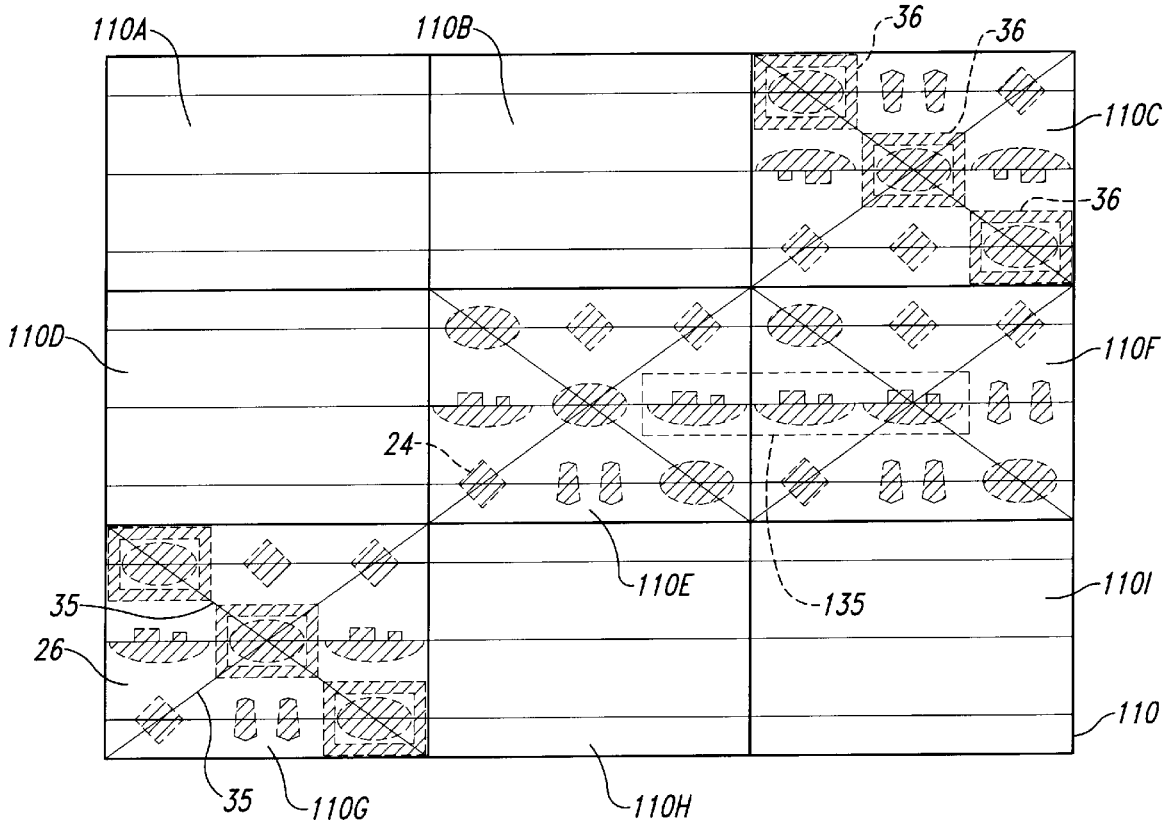
FIG. 8 is an illustration showing a display example of a slot machine showing the third embodiment of the invention.

For example, as shown in FIG. 8, a betting line is set across the display parts E and F. In this case, for example, touch sensors are provided in correspondence with the symbol positions on the front of the display section, and a player touches three symbol positions from among the symbol positions displayed on the display parts, whereby the touched symbol positions can be selected as a betting line. In this case, the selected symbol positions need not be continuously displayed positions and may be any positions within the selected display parts. To set more than one betting line, a betting line selection end button is provided, and each time a player touches three symbol positions, a betting line is set. To complete the selection, the player presses the betting line selection end button for specifying the selection end. The plurality of betting lines can be changed in color, etc., so that they can be distinguished from each other.

Symbol position selection specification buttons corresponding to the symbol positions may be provided in place of the touch sensors.

Further, betting lines may also be selected through the betting line selection section 130 in the second embodiment discussed above.

Although the third embodiment takes selection of three symbol positions as an example, a predetermined number of symbol positions may be selected from among symbols displayed on more than one display part. For example, if a definition is made so as to select nine symbol display positions, a win combination for nine symbols is defined. In this case, for example, as shown in FIG. 2, if a player selects the display parts C, E, and G and further selects the nine symbol display positions of the top positions of the right slots, the center positions of the center slots, and the bottom positions of the left slots on the selected display parts C, E, and G, the game control unit 403 can determine whether or not the combination of the symbols at the nine display positions is the win combination.

This enables the player to set betting lines across the selected display parts, providing an enjoyable gaming machine.

Next, a fourth embodiment of the invention will be discussed. In the fourth embodiment, whether or not the combination of the positions of selected display parts, each determined to be a win in the first embodiment is a predetermined combination is furthermore determined, and if the combination of the positions of the selected display parts, each determined to be a win is the predetermined combination, a predetermined number of game play media are furthermore paid out for the winning game play as a big win.

Figure 9:
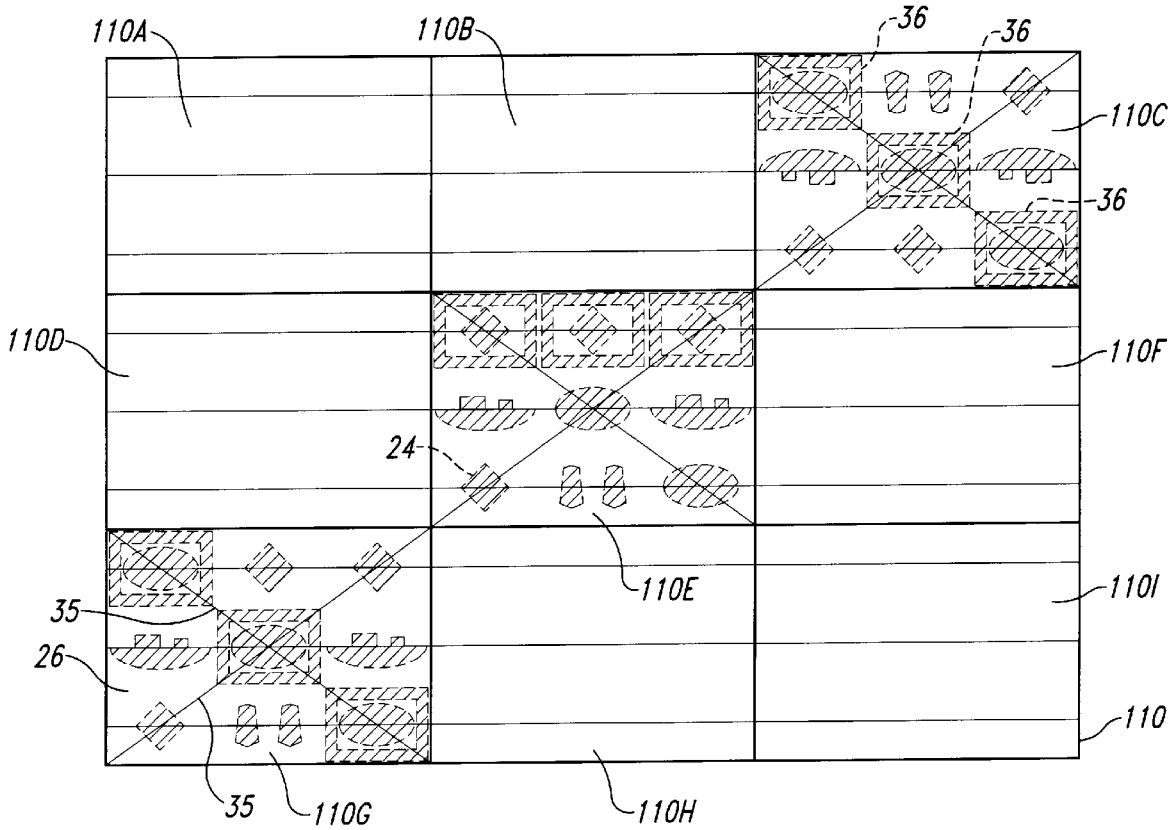
FIG. 9 is an illustration showing a display example of a slot machine showing the fourth embodiment of the invention.

An example wherein when all the three continuous display parts in the horizontal, vertical, or diagonal direction are determined to be wins, it is defined as a big win, will be discussed. In this example, as shown in FIG. 9, when display parts C, E, and G are selected and the game is determined to be a win on every selected display part, a game control unit 403 determines it to be a big win because the display parts C, E, and G are three diagonally continuous display parts. In this case, predetermined music can be output, a predetermined big win display can be produced, and a predetermined number of medals can be paid out for the winning game play as a big win process.

Thus, when a win occurs on selected display parts, if the positions of the display parts determined to be a win are predetermined positions, it can be furthermore determined to be a big win, providing an amusing and enjoyable gaming machine.

Next, a fifth embodiment of the invention will be discussed. The fifth embodiment is an embodiment wherein display parts are selected in response to the input number of game play media without the display selection acceptance section provided in the first embodiment, and wherein if the combination of the positions of the selected display parts each determined to be a win is a predetermined combination, a predetermined number of game play media are furthermore paid out for the winning game play as a big win, as in the fourth embodiment.

The fifth embodiment is also provided with nine display parts 110 (game boards), the number of which to be displayed varies in the range of one to nine depending on the number of input game play media; they are displayed on one liquid crystal display unit at the same time. A plurality of symbols 24 are displayed on each of the nine display parts 110. The number of display parts 110 displayed on the liquid crystal display unit 20 at a time depends on the number of input game play media 54. The embodiment assumes that one display part is displayed with three game play media, that two display parts are displayed with six game play media, that three display parts are displayed with nine game play media, that four display parts are displayed with twelve game play media, that five display parts are displayed with fifteen game play media, that six display parts are displayed with eighteen game play media, that seven display parts are displayed with twenty one game play media, that eight display parts are displayed with twenty four game play media, and that nine display parts are displayed with twenty seven game play media.

Figure 10:
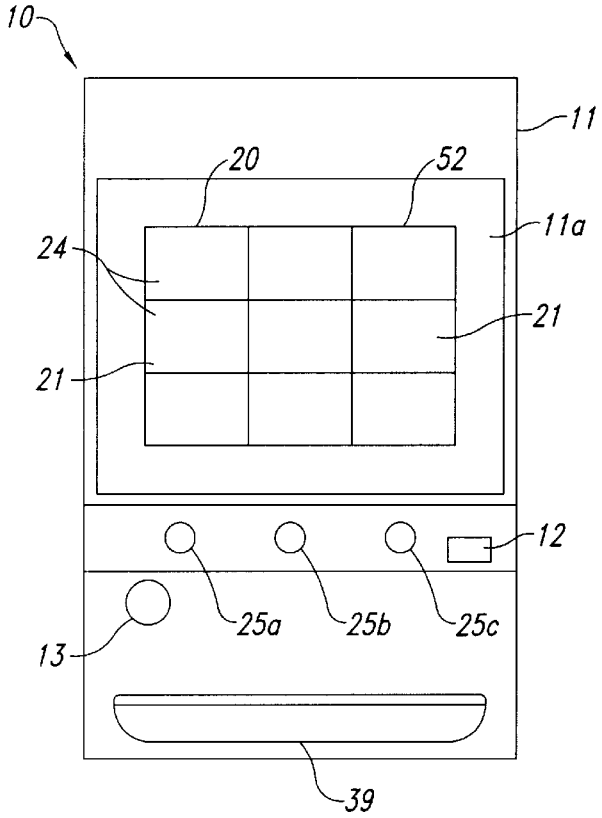
FIG. 10 is an external view of a slot machine showing the fifth embodiment of the invention.

FIG. 10 is an external view of a gaming machine in the fifth embodiment.

In FIG. 10, for the game play operation for combining symbols, when a player inputs game play media into a slot 12 and handles a game play start switch 13, a plurality of symbols 24 are changed on each display part 110 and changing the symbols 24 is stopped at a predetermined stop timing. This symbol combining game play operation is performed on each of the nine display parts 110.

Whether or not the combination of symbols 24 matches a predetermined combination is determined as a symbol combination determination. In the embodiment, a symbol combination determination is made on each of the nine display parts 110 and an additional symbol combination determination can also be made based on the symbol combination determination result. For example, as shown in FIG. 9, a big win condition is determined to exist by the fact that the three display parts 110C, E, and G are each in a win condition and are further diagonally connected.

As shown in FIG. 10, the symbol combination gaming machine 10 is provided with the panel-like liquid crystal display unit 20 on a front 11*a* of a box 11.

Figure 11:
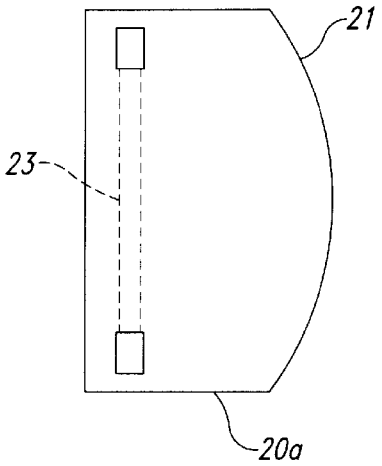
FIG. 11 is a schematic side view of a display unit of the slot machine showing the embodiment of the invention.

As shown in FIG. 11, the liquid crystal display unit 20 contains a backlight 23 behind the display parts 110 for backlighting the display parts 110 so that a player can view the symbols 24 displayed on the display parts 110 brightly from the front.

Three stop operation switches 25*a*, 25*b*, and 25*c* are disposed below the liquid crystal display unit 20. They are stop buttons for selecting a change stop timing of symbols 24 displayed on the liquid crystal display unit 20. The front 11*a* is formed with the slot 12 of medals used as game play media and the game play start switch 13. The symbol combination gaming machine 10 contains a validation section 14 for determining the validity of medals inserted through the slot 12, as shown in FIG. 12.

Figure 12:
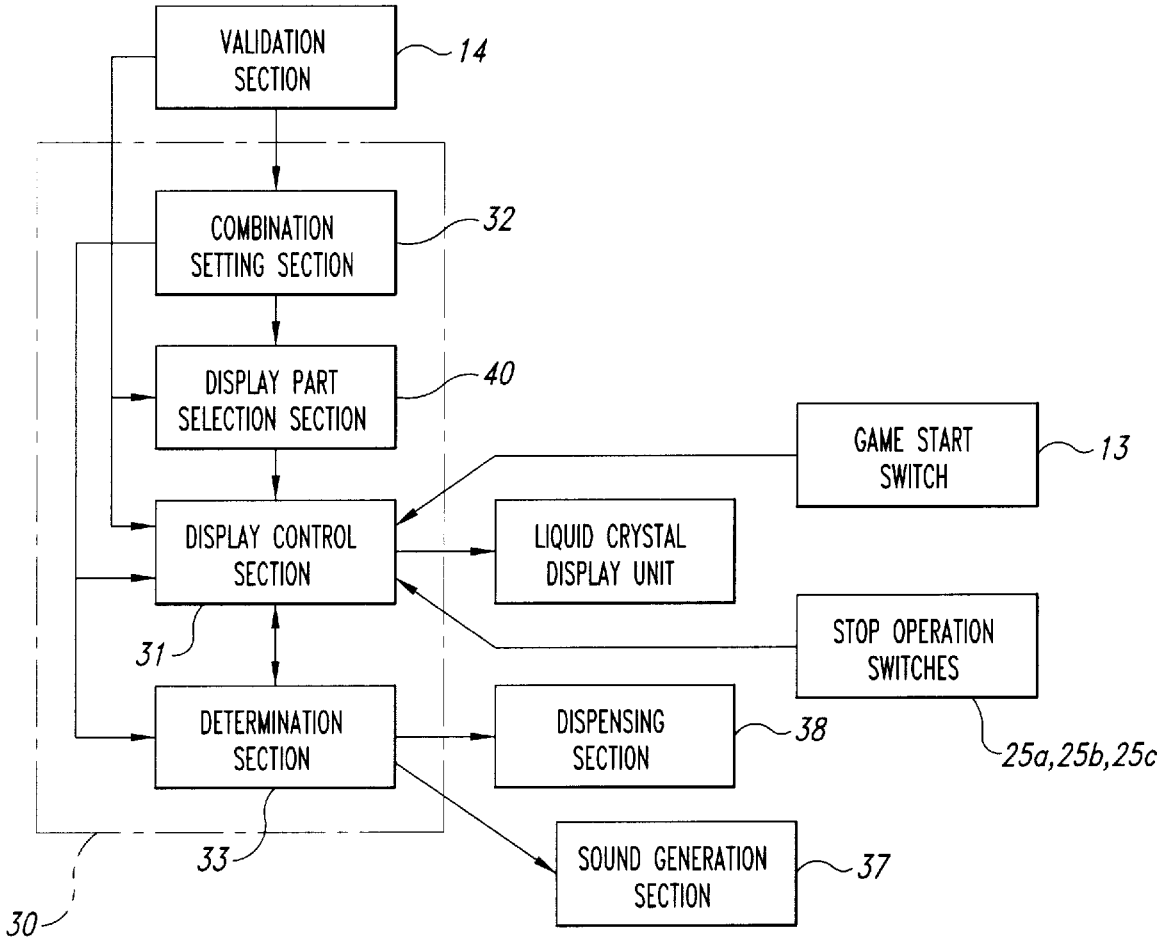
FIG. 12 is a block diagram of the embodiment of the invention.

The symbol combination gaming machine 10 contains a controller 30 shown in FIG. 12. The controller 30 comprises a display control section 31, a combination setting section (betting line setting section) 32 for setting betting lines, a determination section 33 for the symbol combining game play operation, and a display part selection section 40 for selecting display parts in response to the number of input medals.

The determination section 33 determines that the combination of symbols displayed at predetermined positions on each selected display part matches a predetermined symbol combination. The display part selection section 40 selects display parts in response to the number of input medals as defined.

When the validation section 14 determines that input medals are valid, the display control section 31 displays a predetermined number of display parts in response to the number of input medals and causes the liquid crystal display unit 20 to fluently change and display a plurality of types of symbols 24 such as symbols, digits, and characters one after another from top to bottom as a player handles the game play start switch 13. The display control section 31 stops changing the symbols 24 on the corresponding slots on the selected display part on the liquid crystal display unit 20 at predetermined stop timings, namely, the stop timings selected by a player handling the three stop operation switches 25*a*, 25*b*, and 25*c*.

The display control section 31 causes the liquid crystal display unit 20 to produce line displays 35 set by the combination setting section 32.

When the symbol combining game play operation determination section 33 determines that the symbol combination matches a predetermined combination, the display control section 31 causes the liquid crystal display unit 20 to produce display indicating a predetermined win by any one or a combination of: blinking the betting line 135 along the arrangement of the symbols 24 whose combination is determined to match the predetermined combination by the symbol combining game play operation determination section 33;

blinking display of back parts 26 of the symbols 24 whose combination is determined to match the predetermined combination by the symbol combining game play operation determination section 33; and blinking frame displays 36 surrounding the symbols 24 whose combination is determined to match the predetermined combination by the symbol combining game play operation determination section 33.

The combination setting section 32 sets predetermined betting lines.

The symbol combining game play operation determination section 33 determines whether or not the combination of the symbols 24 whose changing is stopped on the liquid crystal display unit 20 matches the predetermined combination, namely, whether or not the symbol combination on the betting line set by the combination setting section 32 matches the predetermined combination.

In the embodiment, the determination section 33 makes the determination on each of the nine display parts 100 and can also make an additional win determination based on the results of the determinations. For example, as shown in FIG. 9, since the three display parts 100 are each in a win condition, and further are diagonally connected, the determination section 33 determines that a new win condition (big win condition) exists.

As shown in FIG. 12, the box 11 contains sound generation means 37, which is adapted to generate a sound indicating a win in response to the determination of the symbol combining game play operation determination section 33.

The box 11 further includes a dispensing section 38, which discharges medals into a return 39 disposed in the lower part of the box 11 for a winning game play when the symbol combining game play operation determination section 33 determines that the symbol combination matches the predetermined combination.

The controller 30 can provide the functions of the display control section 31, the combination setting section 32, and the symbol combining game play operation determination section 33 by appropriately using a programmable microcomputer or its equivalent. For example, if a microcomputer is used, a central processing unit, read-only memory, random access memory, interface, etc., can be provided for the controller 30.

Next, the operation in the fifth embodiment will be discussed. To play a game, a player first inputs as many medals as the number of medals responsive to the number of display parts to be selected into the slot 12 shown in FIG. 10. That is, to select one display part, the player inputs three medals; to select two display parts, he or she inputs six medals; and to select nine display parts, he or she inputs 27 medals.

When the validation section 14 determines that the input medals are valid, the display part selection section 40 selects the display parts in response to the number of medals determined to be valid and the display control section 31 produces line displays 35 set by the combination setting section 32 on each of the selected display parts on the liquid crystal display unit 20, as shown in FIG. 7. For the line displays 35, predetermined betting lines are displayed, for example, like thick lines shown in FIG. 7 (B), (C), and (D). When no medals are input, the line displays 35 are not produced on the liquid crystal display unit 20.

Next, when the player presses the game play start switch 13 shown in FIG. 10, the display control section 31 displays and changes three x symbols 24 one after another on each of the display parts on the liquid crystal display unit 20.

At this time, if the player presses the stop operation switches 25*a*, 25*b*, and 25*c*, changing the corresponding slot symbols 24 on each of the display parts on the liquid crystal display unit 20 is stopped at stop timings responsive to operation of the switches.

When the combination of the symbols 24 in the stop condition displayed on the selected display part matches the predetermined combination, namely, when the determination section 33 determines that the combination of the symbols 24 on the line display 35 produced on the liquid crystal display unit 20 is a predetermined symbol combination and a win for each of the selected display parts, the dispensing section 38 pays out a predetermined number of medals to the return 39 shown in FIG. 10, and at the same time, the sound generation means 37 generates a sound for informing the player that he or she has won the game. In addition, the display control section 31 produces display indicating the win on the liquid crystal display unit 20 for increasing game play amusement by blinking the line display 35 on which the symbol combination is determined to be a win, blinking display of back parts 26 of the symbols 24 on the betting line, or blinking frame displays 36 surrounding the symbols 24 on the betting line. Two or all of the three types of blinking displays may be used in combination. Thus, the player can be informed of which symbol arrangement a win occurs on, and a player's gambling spirit can be aroused.

When the combination of the symbols 24 in the stop condition on the betting line does not match the predetermined combination, a loss condition is set and the above-mentioned operation, such as paying out medals, win display, or sound generation, is not performed. Alternatively, display and sound generation indicating a loss may be performed.

The liquid crystal display unit 20 can be made thinner in depth without changing the number of symbols 24 or their dimensions compared with use of drums, so that the symbol combination gaming machine 10 itself can be made thinner in depth. Therefore, the symbol combination gaming machines 10 can be manufactured with the dimensions of depth, width, etc., matching those of normal pachinko machines, in which case the symbol combination gaming machines 10 and pachinko machines can be installed on the same island, simplifying and facilitating planning, design, and construction of a gaming house.

The liquid crystal display unit 20 can provide power similar to that of symbols displayed on drums compared with the case where a CRT is used to display symbols on one screen. Further, the liquid crystal display unit 20 can produce the illusion and dynamic effect that the drums are rotated if changing of the symbols 24 is real.

Although we have discussed the gaming machine having a liquid crystal display unit, the number of liquid crystal display units is not limited to one and may be any number, two or more.

The liquid crystal display unit may bend as shown in FIG. 11. Further, the liquid crystal display plate may be made flat and the panel face of the case may be made concave so that the liquid crystal display section projects from the panel face.

The stop timings may be selected, not only in response to handling the stop operation switches, but also automatically after a lapse of a predetermined time since symbol display change started.

As the win display, the symbols themselves may be blink-displayed instead of blinking the back parts of the symbols.

When no medals are input, all line displays that can be produced may be produced or the line displays produced in the preceding game play may remain produced on the liquid crystal display unit instead of producing no line displays.

The sound generated by the sound generation means may be a voice forming words. In addition to the medal paying-out time, when no medals are paid out, the sound generation means may also generate a sound informing the player of the event or output a message, such as "too bad!" by voice.

Vibration generation means may be provided in place of or together with the sound generation means for increasing the dynamic effect when medals are paid out.

According to the symbol combination gaming machine according to the embodiment, a plurality of display parts can be displayed on the liquid crystal display unit, so that an enjoyable, powerful, and amusing symbol combination gaming machine can be provided.

Since the liquid crystal display unit can be used to display symbols, thus reducing the depth, the symbol combination gaming machine installation space can be reduced for increasing profits. Particularly if the symbol combination gaming machine is designed having dimensions like a pachinko machine, planning, design, and construction of a gaming house can be simplified for reducing the time and costs required for them.

As discussed in the first to fifth embodiments, according to the invention, active gaming display parts can be selected from among the plurality of display parts and a powerful, amusing, and enjoyable gaming machine can be provided.

I claim:

1. A gaming machine wherein a plurality of types of symbols are dynamically displayed in sequence and a win or loss is determined based on a combination of the symbols displayed when the dynamic display is stopped, said gaming machine comprising:

a display section having a plurality of display areas for dynamically displaying predetermined types of symbols in sequence and displaying a stop condition of the dynamic display, each of the display areas is for displaying a respective game;

a control section for performing display control to cause each of the display areas to make a transition from display in a symbol stop condition to that in a dynamic condition in which the symbols change dynamically, and further to make a transition from the display in the dynamic condition to that in the stop condition;

an active gaming area determination section for selecting at least one display area as an active gaming area among the plurality of display areas;

a judgment section for judging whether or not a respective combination of the symbols displayed in said at least one display area selected by said active gaming area determination section is a respective first predetermined combination when the display in the dynamic condition produced in said at least one display area transitions to the display in the stop condition;

a win processing section for executing a first predetermined win process when said judgment section judges that the respective combination of the symbols is the respective first predetermined combination;

a definition section for defining a plurality of betting lines each indicating positions of symbols whose combination is judged by said judgment section;

a betting line determination section for determining at least one of the betting lines defined by said definition section to be an active betting line used for gaming in the at least one display area selected by said active gaming area determination section;

wherein said judgment section makes the judgment whether the symbol combination is the respective first predetermined combination for each of the betting lines determined by said betting line determination section;

a betting line selection acceptance section for accepting selection specification of at least one active betting line used for gaming among the betting lines defined by said definition section in the at least one display area selected by said active gaming area determination section; and wherein said betting line determination section determines the betting line corresponding to the selection specification accepted through said betting line selection acceptance section to be the active betting line for gaming.

2. The gaming machine as claimed in claim 1 further including a selection acceptance section for accepting selection specification of the at least one display area among the plurality of display areas, wherein said active gaming area determination section selects the at least one display area corresponding to the selection specification accepted through said selection acceptance section as the active gaming area.

3. The gaming machine as claimed in claim 2 wherein said selection acceptance section accepts the selection specification in response to said control section causing the at least one display area to make the transition from the display in the symbol stop condition to that in the dynamic condition.

4. The gaming machine as claimed in claim 1 further including:

media acceptance means for accepting input of game play media used for playing a game; and count means for counting the number of game play media accepted through said media acceptance means, wherein said active gaming area determination section selects as the at least one display area as many display areas as the number defined in response to the number of game play media counted by said count means.

5. The gaming machine as claimed in claim 1 wherein said display section further produces a predetermined display indicating that the at least one display area selected by said active gaming area determination section is an active gaming display area in the display section.

6. The gaming machine as claimed in claim 1 further including an indicator for producing a predetermined display indicating that the at least one display area selected by said active gaming area determination section is an active gaming display area.

7. The gaming machine as claimed in claim 1 wherein said win processing section causes the at least one display area, when displaying the plurality of symbols whose combination is judged to be the respective first predetermined combination by said judgment section, to produce a predetermined win display as the predetermined win process.

8. The gaming machine as claimed in claim 2 further including information means for informing a player that the selection can be accepted through said selection acceptance section.

9. A gaming machine wherein a plurality of types of symbols are dynamically displayed in sequence and a win or loss is determined based on a combination of the symbols displayed when the dynamic display is stopped, said gaming machine comprising:

a display section having a plurality of display areas for dynamically displaying predetermined types of symbols in sequence and displaying a stop condition of the dynamic display, each of the display areas is for displaying a respective game;

a control section for performing display control to cause each of the display areas to make a transition from display in a symbol stop condition to that in a dynamic condition in which the symbols change dynamically, and further to make a transition from the display in the dynamic condition to that in the stop condition;

an active gaming area determination section for selecting at least one display area as an active gaming area among the plurality of display areas;

a judgment section for judging whether or not a respective combination of the symbols displayed in said at least one display area selected by said active gaming area determination section is a respective first predetermined combination when the display in the dynamic condition produced in said at least one display area transitions to the display in the stop condition;

a win processing section for executing a first predetermined win process when said judgment section judges that the respective combination of the symbols is the respective first predetermined combination;

a selection acceptance section for accepting selection specification of the at least one display area among the plurality of display areas;

a definition section for defining a plurality of betting lines, each indicating positions of symbols whose combination is judged by said judgment section;

a betting line determination section for determining at least one of the betting lines defined by said definition section to be an active betting line for gaming in the at least one display area selected by said active gaming area determination section;

a betting line selection acceptance section for accepting selection specification of at least one active betting line used for gaming among the betting lines defined by said definition section in the at least one display area selected by said active gaming area determination section;

wherein said active gaming area determination section selects the at least one display area corresponding to the selection specification accepted through said selection acceptance section as the active gaming area; and wherein said betting line determination section determines the betting line corresponding to the selection specification accepted through said betting line selection acceptance section to be the active betting line for gaming.

10. The gaming machine as claimed in claim 9 wherein said win processing section causes said display section to produce a predetermined win display as the predetermined win process.

11. The gaming machine as claimed in claim 9 wherein there is more than one display area selected by said active gaming area determination section, and wherein said judgment section further judges whether or not a combination of the symbols displayed in two or more of the display areas is a respective second predetermined combination of symbols.

12. A gaming machine wherein a plurality of types of symbols are dynamically displayed in sequence and a win or loss is determined based on a combination of the symbols displayed when the dynamic display is stopped, said gaming machine comprising:

a display section having a plurality of display areas for dynamically displaying predetermined types of symbols in sequence and displaying a stop condition of the dynamic display, each of the display areas is for displaying a respective game;

a control section for performing display control to cause each of the display areas to make a transition from display in a symbol stop condition to that in a dynamic condition in which the symbols change dynamically, and further to make a transition from the display in the dynamic condition to that in the stop condition;

an active gaming area determination section for selecting at least one display area as an active gaming area among the plurality of display areas;

a judgment section for judging whether or not a respective combination of the symbols displayed in said at least one display area selected by said active gaming area determination section is a respective first predetermined combination when the display in the dynamic condition produced in said at least one display area transitions to the display in the stop condition;

a win processing section for executing a first predetermined win process when said judgment section judges that the respective combination of the symbols is the respective first predetermined combination;

a display area combination judgment section for determining whether or not a combination of selected display areas that each display a plurality of symbols whose combination is judged to be the respective first predetermined combination by said judgment section is a respective second predetermined combination; and wherein said win processing section further executes a second predetermined win process different from the first win process when said display area combination judgment section judges that the combination of selected display areas is the respective second predetermined combination.

13. The gaming machine as claimed in claim 12 wherein said win processing section causes the display areas in the combination of display areas to produce a predetermined win display as the second win process.

14. A gaming machine wherein a plurality of types of symbols are dynamically displayed in sequence and a win or loss is determined based on a combination of the symbols displayed when the dynamic display is stopped, said gaming machine comprising:

a display section having a plurality of display areas for dynamically displaying predetermined types of symbols in sequence and displaying a stop condition of the dynamic display, each of the display areas is for displaying a respective game;

a control section for performing display control to cause each of the display areas to make a transition from display in a symbol stop condition to that in a dynamic condition in which the symbols change dynamically, and further to make a transition from the display in the dynamic condition to that in the stop condition, an active gaming area determination section for selecting at least one display area as an active gaming area among the plurality of display areas;

a judgment section for judging whether or not a respective combination of the symbols displayed in said at least one display area selected by said active gaming area determination section is a respective first predetermined combination when the display in the dynamic condition produced in said at least one display area transitions to the display in the stop condition;

a win processing section for executing a first predetermined win process when said judgment section judges that the respective combination of the symbols is the respective first predetermined combination;

wherein there is more than one display area selected by said active gaming area determination section, and wherein said judgment section further judges whether or not a combination of the symbols displayed in two or more of the display areas is a respective second predetermined combination of symbols;

a plural display area betting line definition section for defining a plurality of betting lines which are judged by said judgment section and which indicate respective positions of the plurality of symbols displayed in a plurality of selected display areas;

a plural display area betting line determination section for determining at least one active betting line from among the betting lines defined by said plural display area betting line definition section when there is more than one selected display area, and wherein said judgment section makes the judgment as to whether the symbol combination corresponding to the at least one active betting line is the respective second predetermined combination.

15. The gaming machine as claimed in claim 1 wherein when there is more than one display area determined by said active gaming area determination section, said determination section further determines whether or not a combination of the symbols displayed in the display areas is a predetermined combination of symbols.

16. The gaming machine as claimed in claim 15 wherein said control section only performs the control for the at least one display area selected by said active gaming area determination section.

17. A gaming machine, comprising:

a display section that is operable to display a plurality of display areas for changing and displaying a plurality of predetermined types of symbols in sequence, a control section for performing display control that causes selected display areas to make a transition from display in a symbol stop condition to that in a dynamic condition in which the symbols change dynamically and further to make a transition from the display in the dynamic condition to that in the stop condition;

an active gaming area determination section for selecting one or more display areas as respective active gaming areas among the plurality of display areas;

a judgment section for judging, when there is more than one display area selected by said active gaming area determination section, whether or not a combination of the plurality of symbols displayed in the selected display areas is a predetermined combination of symbols;

a win processing section for executing a predetermined win process when said judgment section judges that the combination of the symbols is the predetermined combination;

a plural display area betting line definition section for defining a plurality of betting lines which are judged by said judgment section and which indicates positions of the plurality of symbols displayed in the plurality of display areas;

a plural display area betting line determination section for determining at least one active betting line used for gaming among the betting lines defined by said plural display area betting line definition section when there is more than one display area selected by said active gaming area determination section;

wherein said judgment section makes the judgment as to whether the symbol combination is the predetermined combination of symbols for each of the betting lines determined by said plural display area betting line determination section;

a plural display area betting line selection acceptance section for accepting selection specification of at least one active betting line used for gaming among the betting lines defined by said plural display area betting line definition section; and wherein said plural display area betting line determination section determines the betting line corresponding to the selection specification accepted through said plural display area betting line selection acceptance section to be the active betting line used for gaming.

18. The gaming machine according to claim 17 wherein when a plurality of said selected display areas displays a predetermined combination of symbols, said judgment section further judges whether a combination of the plurality of said selected display areas matches a predetermined combination of the display areas; and said win processing section executes a predetermined big win process when said combination of the plurality of said selected display areas is the predetermined combination of the display areas.

* * * * *